United States Patent [19]

Bertini

[11] 4,276,722

[45] Jul. 7, 1981

[54] TAP SHARPENER

[76] Inventor: Millo Bertini, 679 Garden St., Trumbull, Conn. 06611

[21] Appl. No.: 116,550

[22] Filed: Jan. 29, 1980

[51] Int. Cl.[3] ..... B24B 19/00

[52] U.S. Cl. ..... 51/225; 51/219 R

[58] Field of Search ..... 51/216 R, 219 R, 219 PC, 51/225

[56] References Cited

U.S. PATENT DOCUMENTS

| | | | |
|---|---|---|---|
| 390,223 | 10/1888 | Gasiorowski | 51/219 PC |
| 630,536 | 8/1899 | Heald | 51/219 R |
| 2,384,899 | 9/1945 | Dixon | 51/219 R |
| 3,349,521 | 10/1967 | Bryant | 51/225 |
| 3,623,852 | 11/1971 | Bushnell | 51/225 |
| 3,722,148 | 3/1973 | Grahn | 51/225 |

FOREIGN PATENT DOCUMENTS

| | | | |
|---|---|---|---|
| 335647 | of 1921 | Fed. Rep. of Germany | 51/225 |

*Primary Examiner*—Harold D. Whitehead

[57] ABSTRACT

A tap sharpener has a base defining a base axis and carrying a support which is pivotal on the base about a support axis inclined to the base axis. A tap holder is fixed on the support for joint rotation therewith about the support axis and has a retainer for securing a tap on the tap holder with the central axis of the tap extending parallel to the support axis. A slide between the holder and the support allows for displacement of the holder on the support in a direction passing perpendicularly through the support axis and through the central axis of a tap secured by the retainer in the holder. An indexing stop is provided for angularly positioning the tap relative to the holder in a predetermined angular position relative to the tap axis and to the support. The sharpener allows virtually any type of tap to be sharpened with any type of angular and axial relief angle.

10 Claims, 7 Drawing Figures

TAP SHARPENER

FIELD OF THE INVENTION

The present invention relates to a machine for sharpening a tap. More particularly this invention concerns such an apparatus used in a machine shop for resharpening a tap which has become dull with use or whose end has been broken off.

BACKGROUND OF THE INVENTION

A device for sharpening taps is known from U.S. Pat. No. 3,722,148. This arrangement can be set up to displace a tool-holder through an eccentric path. The tap is mounted in a collet in the holder and can be appropriately positioned with respect to a grinding wheel to refinish the end of the tap. Under normal circumstances the tap end only needs to be refinished, as it is only this portion of the tool which is subjected to any appreciable wear.

This device has several considerable disadvantages. It requires a separate collet for each size of tap, to center it in the holder. The expense involved in providing all these collets is considerable, in particular as they must be meticulously machined to close tolerances. What is more, it is only possible to sharpen standard taps with the device. A tap whose angular relief varies from the standard one cannot be refinished with such an apparatus. The eccentricity of the tool-holding sleeve is fixed, so that the usefulness of the device is rather limited.

OBJECTS OF THE INVENTION

It is therefore an object of the present inventions to provide an improved tap-sharpening apparatus.

Another object of this invention is to provide such an apparatus which, without the use of collets, can be used to resharpen virtually any type of tap having virtually any angular or end relief angle and having virtually any number of flutes.

A further object is to provide such an apparatus which is relatively easy to use and inexpensive to manufacture.

SUMMARY OF THE INVENTION

These objects are attained according to the instant invention in a tap sharpener having a base that defines a base axis and that carries a support rotatable on the base about a support axis inclined to the base axis. A tap holder in turn is fixed on the support for joint rotation therewith about the support axis. Retaining means on the tap holder is provided for securing a tap thereon with the central tap axis extending parallel to the support axis. Slide means between the holder and the tap serves for displacement of the holder on the support in a direction parallel to a plane defined by the support axis and the central tap axis. Thus it is possible, according to the instant invention, to vary the eccentricity of the support on the base at will. As a result, the use of expensive collets can be completely elminated, as the relationship between the support axis, about which the work holder is pivoted, and the central tap axis can be varied for virtually any size tap.

According to this invention, the retaining means includes a pair of generally perpendicular planar surfaces in the holder which symmetrically flank the above-mentioned plane, and an element which presses the cylindrical shank of the tap against these two surfaces so as perfectly to center its tap axis on the plane.

In accordance with another feature of this invention, indexing means is provided including a stop which can angularly engage an edge of a row of teeth on the tap, fitting into the adjacent flute, so as to define a predetermined angular position for the tap with respect to the tap axis. This stop is displaceable freely in a plane perpendicular to the tap and support axis, so that it can be brought to bear on any flute in any direction, to hold the respective tap in the desired angular position. Therefore, it is a relatively easy job to set the machine up to produce any of several different desired relief angles for different working conditions or materials. According to another feature of this invention, the stop is biased radially inwardly toward the tap, but is movable against this biasing force outwardly, so that all a user needs to do once the device has been set up and one of the rows of teeth has had its forward edge properly ground, is to push the stop away against the force of its spring biased and turn the tap in the holder to bring the next row of teeth into the same position for grinding it also. The device, therefore, allows even a relatively unskilled worker to quickly resharpen a tap.

The savings entailed with the use of such a machine are enormous, as it allows taps to be resharpened so that their service lives are multiplied by a considerable factor. What is more, the machine is operated in a relatively simple manner, so that it need merely be set up on a magnetic chuck adjacent to a grinding wheel by the user who with limited experience will be able to resharpen any type of tap. Even taps having relatively rare relief angles can be sharpened properly. By the same token, it is possible to change the relief angle of a given tap with the tool according to this invention, in the event that such a procedure is necessary.

According to the instant invention, the support is constrained against moving through more than approximately 90° relative to the base. Since taps, usually, have at least four flutes, such a retainer will ensure that only one flute at the time is ground down. In the event that taps having more than four flutes are to be sharpened, it is, of course, within the scope of this invention to modify the retainer so that it prevents motion through more than the angular dimension of a single row of teeth.

SPECIFIC DESCRIPTION

Figures 1A, 1B, 1C, 1D:
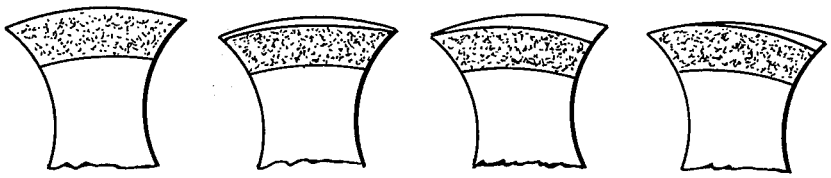
FIGS. 1*a*–1*d* illustrate various relief angles producible according to this invention.

As shown in FIGS. 1*a*–1*d*, it is possible for a tooth of a tap to apply at least four different relief angles. FIG. 1*a* shows the standard relief angle, wherein the outer surface of the tip of the tap is exactly concentric to the tap.

In FIGS. 1*a* and 1*b* center relief is shown, wherein the outer surface of a tooth at the leading end of the tap has a radius of curvature which is somewhat smaller than that at the base of the tooth.

In FIG. 1*c* eccentric relief is shown, where the centers of curvature are not both on a diameter extending through the middle of the tooth.

Finally, FIG. 1*d* shows so-called con-eccentric relief, which is actually a combination of the types shown in FIGS. 1*a* and 1*c*. It is possible, according to the instant invention, to obtain all of these and other types of relief with the apparatus described below.

Figure 2:
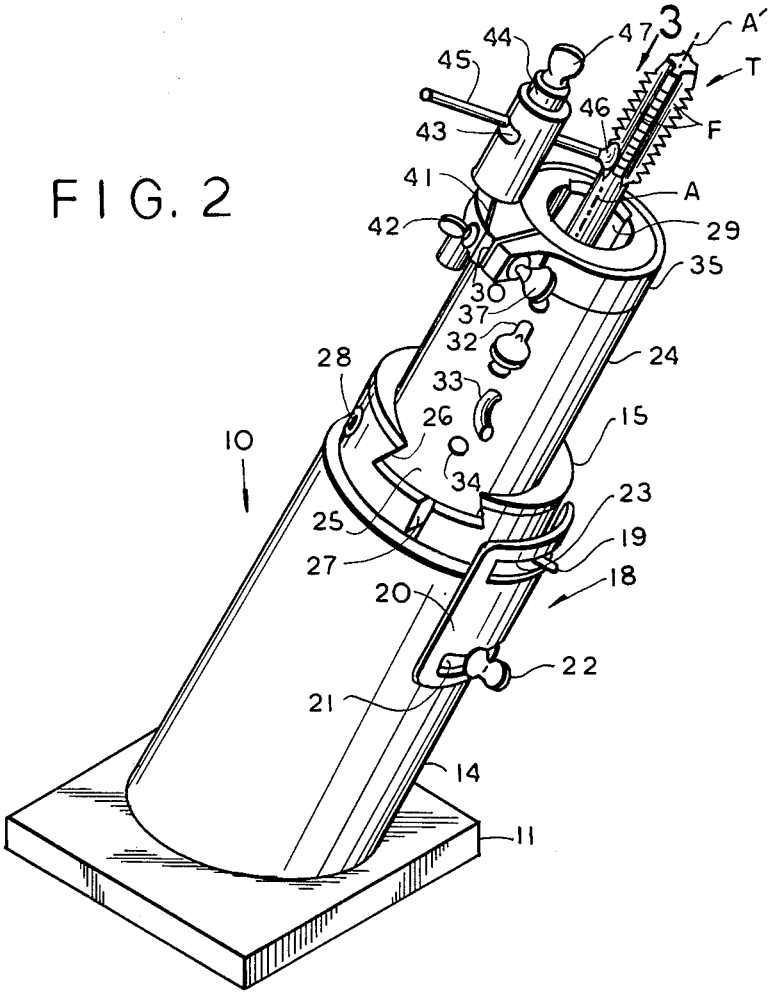
FIG. 2 is a perspective view of the apparatus according to this invention.
Figures 3, 4:
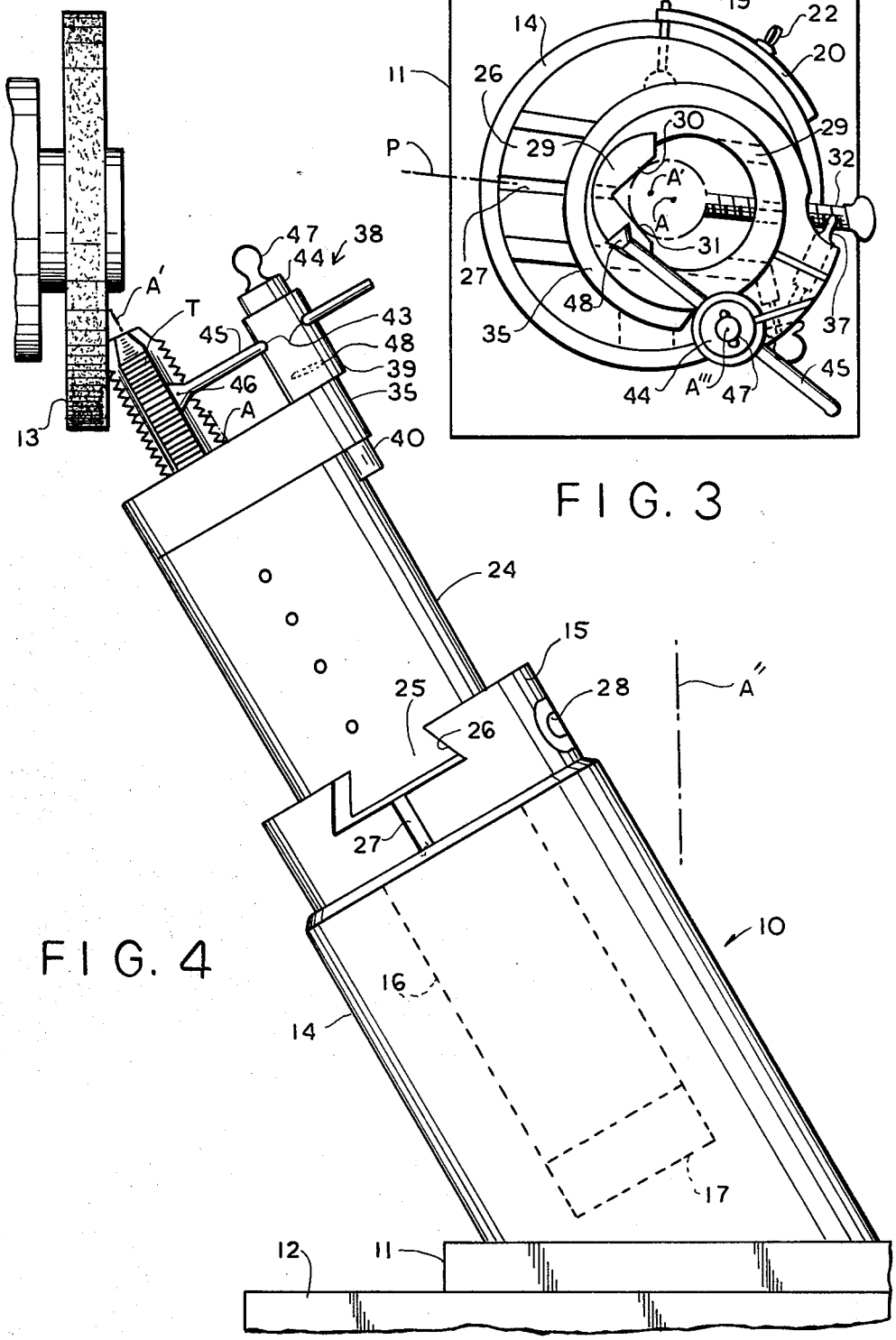
FIG. 3 is an end view taken in the direction of arrow III of FIG. 2.
FIG. 4 is a side view showing the machine according to this invention in use.

As seen in FIGS. 2, 3 and 4, the tool according to this invention has a base 10 formed as a flat, mild-steel plate 11 having a lower surface extending perpendicular to a base axis A″ which, in fact, can be located anywhere relative to the plate 11, which is adapted to be held down on a standard magnetic chuck 12 adjacent a standard cylindrical grinding wheel 13 rotated about a horizontal axis perpendicular to the axis A″. Carried on this base plate 11 is a sleeve or column 14 defining a main support axis A extending here at an angle of 60° to the lower surface of the plate 11 and, therefore, at an angle of 30° to the axis A″.

A support 15 is co-axially received in the column 14 and has a stem 16 extending down therein and connected at the base to a thrust bearing 17. Thus, this support 15 can rotate about the axis A freely.

As seen in FIG. 2 stop means 18 is provided on the column 14 to co-act with a pin 19 extending radially from the support 15. This stop means 18 includes an arcuate plate 20 having a lower slot 21 through which passes a finger screw 22 and an upper slot 23, through which extends the pin 19. The slot 23 has an arc length of 90°, so that the pin 19 prevents the support 15 from rotating through more than 90°.

Mounted atop this support 15 is a workpiece holder 24 which rotates jointly with the support 15 about the axis A on the base 10. A dovetail ridge 25 formed on the lower surface of the tubular holder 24 fits in a dovetail groove 26 of the support 15 so that the holder 24 can move in a plane P perpendicular to the axis A. The support 15 is cleft at 27 along this plane P and is provided with a transversely throughgoing Allen screw 28 that allows it to clamp itself tightly to the opposite side 9 of the ridge 25 to lock it fixedly in place in the support 15.

A tap T having four longitudinal flutes F and centered on an axis A′ can be held against a seat 29 (FIG. 3) having a pair of planar surfaces 30 and 31 extending at a right angle to each other and symmetrically flanking the above-mentioned plane P defined by the axis A in the direction of displacement of the holder 24 on the support 15. A screw 32 threaded through the wall of the tubular holder 24 on this plane P can, therefore, press the shank of the tap T against these surfaces 30 and 31 to align the axis A′ of the tap T perfectly on this plane P. The lower end of the tap T stands on an L-shaped rod 33 passing through any of several holes 34 formed on the support 24 at the plane T.

A ring 35 grips the upper end of the holder 24 and is formed with a split 36 spanned by a finger screw 37, so that this ring 35 may rotate freely about the support 24 but be locked at any position thereon. An indexing means 38 is carried on this ring and is formed basically as a tubular support 39 having a stem 40 passing through a hole in the ring 35 at a slit thereof, so that another finger screw 42 can lock this element 39 at any angular position on the ring 35.

The sleeve 39 is formed on its opposite sides with arcuate slots 43 and is provided internally with a plug 44. A rod stop having a stem 45 and a widened end 46 extends through these slots 43 and through a diametral hole in the plug 44. A further finger screw 47 can lock the stem 45 in the plug 44. A biasing spring indicated schematically in FIG. 4 at 48 urges the plug 44 clockwise, as seen in FIG. 3 so that the widened end 46 will normally move radially inwardly of a tap T held in the seat 29. Thus the angular position of all of the flutes F of the tap T relative to the axis A′ of the tap T is established by the indexing arrangement 38.

In use a tap whose end has become dull or whose end has been broken off is fitted onto the seat 29 with its lower end standing on the shank of the L-shaped stop 33 which is positioned in one of the holes 34 so that the entire threaded portion of the tap T stands outside the seat 29. The finger screw 32 is then tightened just enough to hold the cylindrical shank of the tap T in line contact with each of the planar surfaces 30. The entire device is then rested on a magnetic chuck 12 adjacent the grinder 13 and is pivoted about the axis A″ until the axis A′ forms the desired relief angle with the planar face of the grinder 13. The chuck 12 is then energized to lock the entire unit in place. Thereafter the stop arrangement 38 is adjusted so that one of the rows of teeth is positioned in the desired orientation relative to the axis A′. The grinder 13 is started up and the user, by hand, merely pivots the holder 24 through approximately 90° of arc to grind down and sharpen the one row of teeth. Thereupon stop arrangement 38 is pivoted to the side, and the tap T is pivoted around so the next row of teeth can be similarly machined. Whether the tap has three, four, five or virtually any number of rows of teeth, it is possible for the user to rapidly grind down the teeth in the same number of steps. If necessary, the finger screw 22 can be loosened to move the plate 20 so that the arc through which the holder 24 rotates relative to the base 10 can be varied.

For the type of grind shown in FIG. 1*a*, the screw 28 is loosened and the entire holder 24 is moved in the dovetail groove 26 so that the axes A and A′ are coaxial. Thereupon the screw 28 is tightened.

In order to produce the type of grind shown in FIG. 1*b* the holder 24 is moved on the support 15 so that, substantially as shown in FIG. 4, the axis A′ is well offset from the axis A toward the wheel 13. For this type of grind, as well as for the type of grind in FIG. 1*a*, the plane P must bisect the row of teeth being sharpened.

On the contrary, when grinding to produce the shape shown in FIG. 1*c*, the trailing edge of the tap teeth, relative to the normal direction of the use of the tap, is positioned on the plane P.

Finally, to create the type of grind shown in FIG. 1*d*, the arrangement is first set up as for FIG. 1*a*, that is with the axis A and A′ coaxial, and then the stop 38 is adjusted to obtain the desired tangency point.

It is obvious that the sharpener according to the instant invention can equally well be used for left-hand taps, in which case the screw 37 is loosened and the entire ring 35 is moved to the other side of the seat 29.

It is, therefore, possible for a machinist, using the tap sharpener according to this invention, to resharpen virtually any type of tap to virtually any type of grind, even easily reproducing some of the less common grinds. The device can be produced at relatively low cost. The various parts are all provided with graduations and indicators so that even a relatively unskilled machinist can rapidly consult a simple instruction book to establish the settings for the various types of taps. It is possible to fit the plate 11 for pivoting about the axis A" on a chuck such as shown at 12, in which case further graduations are provided to indicate the exact angular position. Furthermore, it is possible to use a motor or small cylinder to effect the oscillatory motion of the holder 24 on the base 10 if desired.

I claim:

1. An apparatus for sharpening a fluted tap, said apparatus comprising:

a base defining a base axis;

a support fixed on said base and pivotal thereon about a support axis inclined to said base axis;

a tap holder fixed on said support for joint rotation therewith about said support axis;

retaining means on said tap holder for securing a tap thereon with the central axis of said tap extending parallel to said support axis;

slide means between said holder and said support for displacement of said holder on said support in a direction passing perpendicularly through said support axis and through the central tap axis of a tap secured by said retaining means in said holder.

2. The apparatus defined in claim 1 wherein said tap has axially extending flutes and therebetween axially extending rows of cutting teeth, said apparatus further comprising indexing means for angularly positioning said tap relative to said holder in a predetermined angular position relative to the tap axis and to said support.

3. The apparatus defined in claim 2 wherein said indexing means includes a stop mounted on said holder and pivotal thereon about a stop axis parallel to said holder axis, said stop having an end engageable in a direction perpendicular to said stop axis with any edge of any row of teeth of a tap in said holder.

4. The apparatus defined in claim 3, wherein said indexing means includes a spring urging the stop and radially inwardly of said tap axis toward said tap.

5. The apparatus defined in claim 1 wherein said slide means includes an interfitting groove and slot extending in a plane including said holder and tool axes and said direction on said holder and support.

6. The apparatus defined in claim 1, further comprising means for locking said holder against displacement in said direction in any of a multiplicity of positions on said support.

7. The apparatus defined in claim 1, further comprising means for limiting rotation of said holder about said support axis on said support to an angle of approximately 90°.

8. The apparatus defined in claim 1 wherein said holder is formed with a pair of mutually generally perpendicular surfaces extending parallel to said support axis and flanking the plane of said support axis and direction, said retaining means including an element displaceable in said direction on said holder for urging the cylindrical shank of said tap in said direction against said surfaces to center the tap axis on said plane.

9. The apparatus defined in claim 1, further comprising stop means on said holder for preventing insertion of a tap into said holder parallel to said support axis beyond a predetermined location.

10. The apparatus defined in claim 1 wherein said base includes a base plate having a planar lower face extending perpendicular to said base axis and a column extending along said support axis and carrying said support.

* * * * *